United States Patent [19]

Gearhart

[11] 4,199,742

[45] Apr. 22, 1980

[54] BUBBLE DEFLECTOR FOR VAPOR COOLED TRANSFORMERS

[75] Inventor: Robert E. Gearhart, Rome, Ga.

[73] Assignee: General Electric Company

[21] Appl. No.: 4,498

[22] Filed: Jan. 18, 1979

[51] Int. Cl.[2] ..... H01F 27/10

[52] U.S. Cl. ..... 336/58

[58] Field of Search ..... 336/55, 57, 58, 60, 336/94; 174/15 R; 310/52, 54

[56] References Cited

U.S. PATENT DOCUMENTS 3,663,910 5/1972 Grubb ..... 336/58 X

*Primary Examiner*—Thomas J. Kozma

*Attorney, Agent, or Firm*—Francis X. Doyle

[57] ABSTRACT

A bubble deflector for a vapor-cooled transformer comprises an insulating member, such as pressboard, which is placed under the upper yoke member of the transformer core to deflect vapor bubbles away from the bottom area of the upper yoke member of such core.

3 Claims, 4 Drawing Figures

BUBBLE DEFLECTOR FOR VAPOR COOLED TRANSFORMERS

BACKGROUND OF THE INVENTION

This invention relates to a vapor-cooled transformer and, more particularly, to a bubble deflector for such vapor-cooled transformer.

As is well known to those skilled in the transformer art it is necessary that the dielectric strength of the cooling and insulating liquid be maintained throughout the life of the transformer. In oil-cooled apparatus the oil and other insulation are thoroughly dried to prevent water accumulation. Further, the equipment is usually filled under vacuum to prevent any air from forming in the system. Since air has a dielectric constant of approximately one, which is substantially lower than that of oil, any air in the system will assume a disproportionate share of the dielectric stress which could, of course, lead to a possible failure of the transformer.

In vapor-cooled transformers the cooling is provided by the boiling or vaporization of the liquid in the transformer. The operation of vapor-cooled transformers is more fully disclosed in application Ser. No. 843,676 filed Oct. 19, 1977 for "Percolation Cooled Transformer" in the name of R. E. Gearhart et al (the applicant herein) and which is assigned to the same assignee as this application. As will be understood, the vapor bubbles also have a low dielectric constant of one as compared to the dielectric constant of 2.2 or more for the cooling and insulating fluid of the vapor-cooled transformer. If these vapor bubbles should accumulate between the coil, which is at a high voltage, and the core, which is normally at ground, a failure could occur between these components across such vapor bubble.

It is one object of this invention to provide a bubble deflector between the core and coil of a vapor-cooled transformer to prevent the accumulation of vapor bubbles between such core and coil.

A further object of this invention is to provide a bubble deflector beneath the lower portion of the upper yoke of the core and above the coil of a vapor-cooled transformer.

SUMMARY OF THE INVENTION

Briefly, in one form, this invention comprises an insulated member mounted between the upper yoke member of the core of a transformer. The insulated member is angled from the center of such core member upwardly to deflect any vapor bubbles which rise from the coil and prevent them from going under such upper yoke member.

The invention, which is sought to be protected, will be clearly pointed out and distinctly claimed in the claims appended hereto. However, it is believed that this invention, and the manner in which its objects and advantages are obtained, as well as other objects and advantages thereof, will be better understood by reference to the following detailed description of the present preferred embodiment, especially when considered in the light in the accompanied drawings.

DETAILED DESCRIPTION OF THE INVENTION

Figure 1:
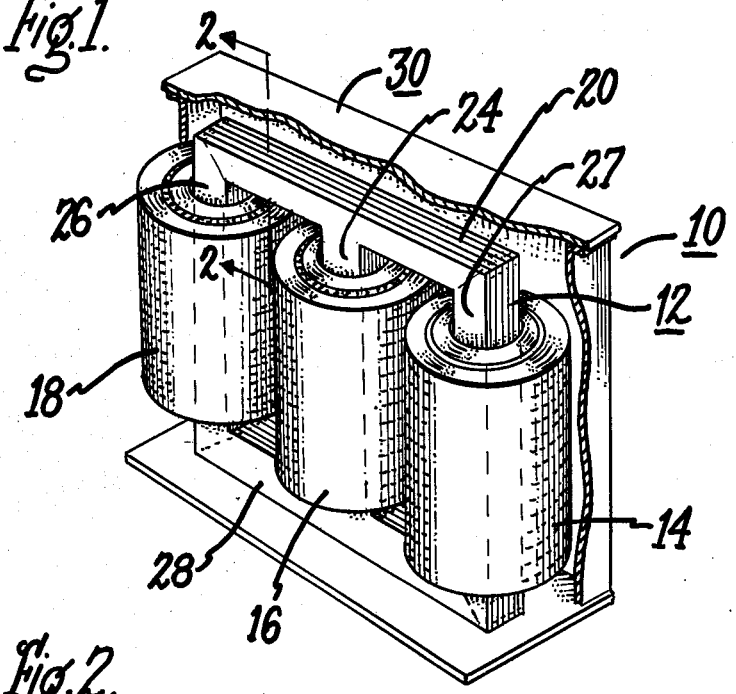
FIG. 1 is a partial perspective view with parts broken away of one form of transformer to which this invention could be applied.

As above noted this invention relates to a bubble deflector for use in a vapor-cooled transformer. FIG. 1 shows a partial broken-away view of a transformer 10 which includes the core unit 12 and a plurality of coil members 14, 16, and 18. As is apparent from FIG. 1, the core 12 has an upper yoke section 20 depending coil winding legs 22, 24, 26 and lower yoke member 28, with windings 14, 16, and 18 placed on the appropriate winding legs, as shown. The entire core and coil unit may be surrounded by a tank 30 and a cooling and insulating fluid will be placed within the tank, as is well known to those skilled in the art.

Figure 2:
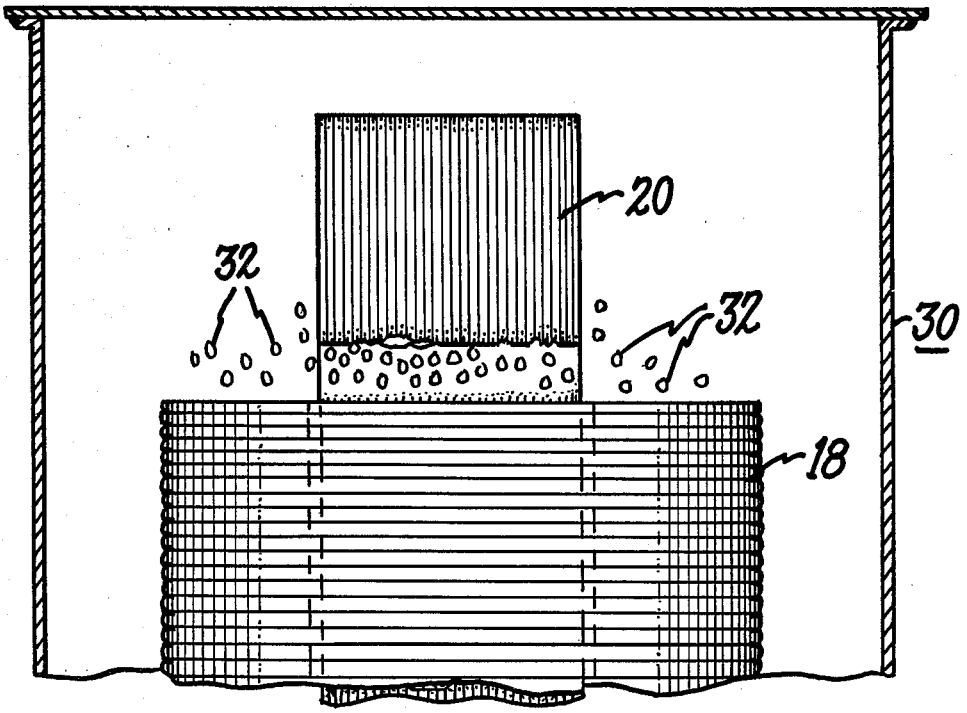
FIG. 2 is a partial sectional view, taken on line 2—2 of FIG. 1, showing the formation of bubbles in a vapor-cooled transformer.

Should the cooling fluid be a vapor-cooling fluid, in the manner described in the earlier mentioned application Ser. No. 843,676, then as the cooling fluid is subject to the heat of operation, a plurality of vapor bubbles are formed within the coil unit and the vapor bubbles ascend upwardly into the upper portion of the transformer. This is shown particularly in FIG. 2 which is essentially a partial sectional view taken on the line 2—2 of FIG. 1. As is shown in FIG. 2 the vapor bubbles 32 arise from the coil unit 18 and may settle under the upper yoke member 20, in the manner indicated. Should the bubbles be allowed to accumulate under the yoke member 20, the dielectric constant of the bubbles being very low, it would cause the dielectric stress to be placed mostly across the accumulated bubbles. This could lead to a possible short circuit between the core 20 and coil 18 which, as will be understood, could lead to a failure of the transformer. In order to prevent such failure, the bubble deflector of this invention has been provided.

Figure 3:
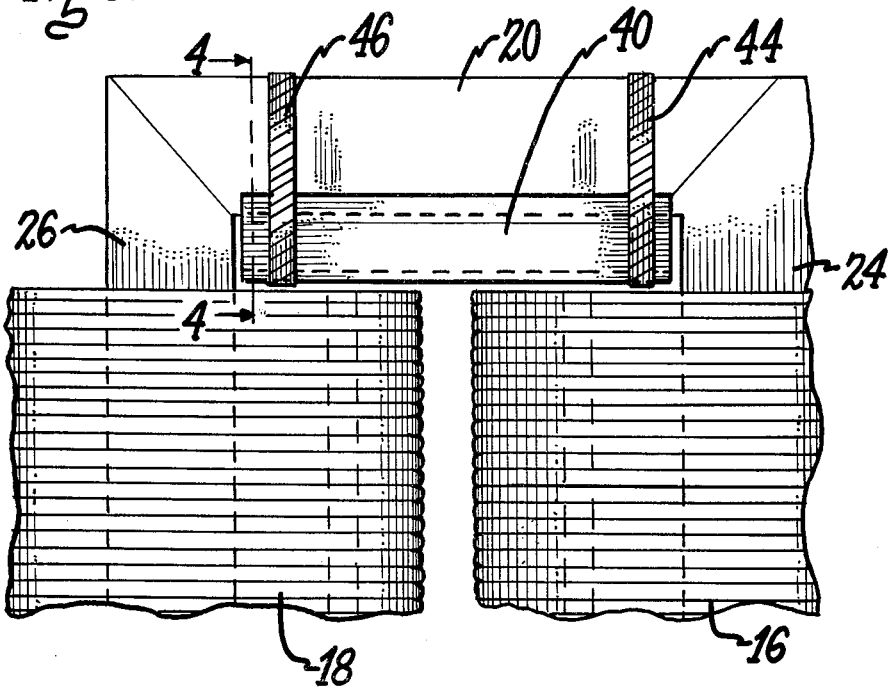
FIG. 3 is a partial sectional view of a portion of the core and coil of a vapor-cooled transformer showing a preferred embodiment of the bubble deflector of this invention.
Figure 4:
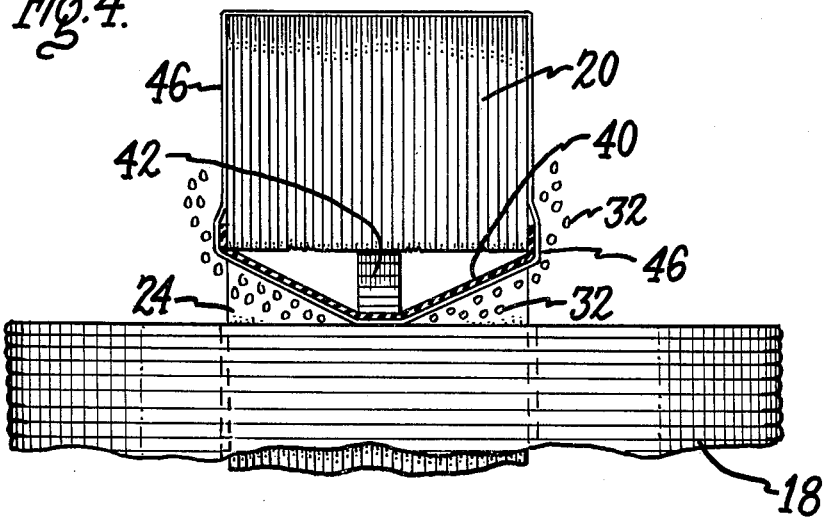
FIG. 4 is a partial sectional view taken on the lines 4—4 of FIG. 3.

The present preferred embodiment of the bubble deflector of this invention is best shown in FIGS. 3 and 4 of the drawing, to which reference will now be made. FIG. 3 is a partial sectional view of a portion of the core and coil unit, for example, the unit shown in FIG. 1. FIG. 3 shows the upper yoke member 20, winding leg 26, and portions of coil 16 and 18. Beneath upper yoke 20 and over the top of the coil unit 16 and 18 the bubble deflector 40 of this invention is provided. FIG. 4, which is a partial sectional view taken on the line 4—4 of FIG. 3, shows a better indication of the shape of the bubble deflector 40. As is clearly indicated in FIG. 4, the center portion of bubble deflector 40 is spaced from the upper yoke member 20 by means of spacers 42, which may be any type of insulation material such as, for example, a plurality of layers of pressboard. The bubble deflector 40 which may itself be a large sheet of pressboard is angled upwardly from the center to the edge of the yoke 20 in the manner clearly indicated in FIG. 4. As is shown, particularly in FIG. 3, the bubble deflector 40 is held tightly against the yoke 20 by means of insulated bands, for example, bands made of nylon, shown at 44 and 46 in FIG. 3. As will be understood a bubble deflector 40 will be provided between each winding and the lower portion of the upper yoke member in the manner necessary to provide protection to deflect the bubbles which form within the winding.

As is clearly shown in FIG. 4, as the bubbles 32 ascend from the winding 18 the bubbles engage the bubble deflector 40 and are directed outwardly away from the lower portion of upper yoke 20, thereby preventing any accumulation of bubbles underneath the upper yoke member 20. Thus, the bubble deflector will prevent any accumulation of bubbles which could cause a dielectric failure between the portion of the core and the winding.

While there has been shown and described, the present preferred embodiment of the invention it will, of course, be understood by those skilled in the art that various changes may be made in the particular position, material, and construction of the bubble deflector without departing from the spirit and scope of the invention, particularly as is set forth in the appended claims.

What is claimed as new and which it is desired to secure by Letters Patent of the United States is:

1. A vapor-cooled transformer comprising a tank with a vaporizable liquid dielectric therein, a core with a coil thereon, an insulated member secured to the core between the core and coil and angled so as to deflect vapor bubbles forming in the coil away from the core.

2. A vapor-cooled transformer as set forth in claim 1 in which the deflector is secured to the upper yoke and is spaced from the center of the yoke and angled outwardly from such spacing to the sides of the yoke.

3. A vapor-cooled transformer as set forth in claim 2 in which the deflector is formed from an insulated pressboard.

* * * * *